United States Patent [19]

Kohama et al.

[11] 4,250,855

[45] Feb. 17, 1981

[54] ELECTRONIC CONTROL SYSTEM FOR CARBURETOR

[75] Inventors: Tokio Kohama, Nishio; Takeshi Matsui; Akira Nishimatsu, both of Aichi; Kiyoshi Kobashi, Mishima; Hisasi Kawai, Toyohashi; Toshikazu Ina, Okazaki; Hidetaka Nohira, Mishima, all of Japan

[73] Assignees: Nippon Soken, Inc., Nishio; Toyota Jidosha Kogyo Kabushiki Kaisha, Toyota, both of Japan

[21] Appl. No.: 54,432

[22] Filed: Jul. 3, 1979

[30] Foreign Application Priority Data

Jul. 4, 1978 [JP] Japan ..... 53-81363

[51] Int. Cl.[3] ..... F02M 7/24

[52] U.S. Cl. ..... 123/438

[58] Field of Search ..... 123/119 EC, 124 B, 119 D, 123/32 EE

[56] References Cited

U.S. PATENT DOCUMENTS

| | | | |
|---|---|---|---|
| 3,861,366 | 1/1975 | Masaki et al. | 123/119 EC |
| 4,083,341 | 4/1978 | Brettschneider et al. | 123/119 EC |
| 4,136,645 | 1/1979 | Ito et al. | 123/119 EC |
| 4,155,336 | 5/1979 | Hallberg | 123/119 EC |
| 4,201,159 | 5/1980 | Kawai et al. | 123/32 EE |

*Primary Examiner*—Charles J. Myhre
*Assistant Examiner*—Andrew M. Dolinar
*Attorney, Agent, or Firm*—Cushman, Darby & Cushman

[57] ABSTRACT

In a carburetor for an internal combustion engine, a control valve is disposed with an air passage through the carburetor structure to control the flow quantity of air to be mixed with fuel from a float chamber and a pneumatic servo-motor is operatively connected with the control valve to control the opening degree of the valve. The pneumatic pressure applied to the servo-motor is electrically controlled to satisfy the following function in relation to the engine intake manifold vacuum and the engine speed.

$$Pd=f(Pv, N)$$

where the character Pd is the pneumatic pressure applied to the servo-motor, and the characters Pv and N respectively indicate the engine intake manifold vacuum and the engine speed.

4 Claims, 16 Drawing Figures

ELECTRONIC CONTROL SYSTEM FOR CARBURETOR

BACKGROUND OF THE INVENTION

The present invention relates to an electronic control system for a carburetor adapted to an internal combustion engine, and more particularly to an electronic control system for a carburetor of the type having air and fuel passages through the carburetor structure.

SUMMARY OF THE INVENTION

To control the function of a carburetor of this type in accordance with operating conditions of an associated internal combustion engine, a carburetor has been provided by the inventors which comprises a control valve disposed within an air passage through the carburetor structure to control the flow quantity of air to be mixed with fuel from a fuel chamber, and a pneumatic servo-motor operatively connected with the control valve to control the opening degree of the valve. In an experimentation conducted by the inventors, pneumatic pressure of various values has been applied to the servo-motor to vary the flow quantity of air passing through the air passage so as to ensure the proper fuel-to-air ratio for all operating conditions of the engine.

As a result of the experimentation, it has been observed that if the pneumatic pressure applied to the servo-motor satisfies the following function in relation to the engine intake manifold vacuum and the engine speed, the proper fuel-to-air ratio can be obtained in accordance with various operating conditions of the engine. In addition, it is noted that the following function can be commonly adapted to various type of internal combustion engines.

$$Pd = f(Pv, N) \ldots \quad (1)$$

where the character Pd indicates the pneumatic pressure applied to the servo-motor under the atmospheric pressure of 760 mmHg at 20° C., and the characters Pv and N respectively indicate the engine intake manifold vacuum and the engine speed.

As shown in FIG. 1, the above function (1) is experimentarily represented as a plurality of annular characteristic curves Pd which are indicated in relation to the engine intake manifold vacuum Pv and the engine speed N. In this figure, the characteristic curves Pd indicate higher pneumatic pressure at the inside thereof than that at the outside thereof. In the actual practice of the present invention, the intake manifold vacuum Pv is indicated in a predetermined scale ΔPv (For instance, ΔPv=25 mmHg) along the ordinate, and the engine speed N is indicated in a predetermined scale ΔN (For instance, ΔN=200 r.p.m.) along the abscissa. Thus, a plurality of pneumatic pressure values f(lΔPv, mΔN) are obtained in the form of a map or table defined by the above respective scales lΔPv, mΔN (l, m=1,2, . . .). To calculate the pneumatic pressure values, the following inequalities and equations are used in relation to the respective values Pv, N, ΔPv, ΔN, the integers l, m, and the above table.

$$l\Delta Pv \leqq Pv < (l+1)\Delta Pv \quad (2)$$

$$m\Delta N \leqq N < (m+1)\Delta N \quad (3)$$

$$Pd' = \frac{\{(l+1)\Delta Pv - Pv\} f(l\Delta Pv, m\Delta N)}{\Delta Pv} \quad (4)$$

-continued $$+ \frac{(Pv - l\Delta Pv) f\{(l+1)\Delta Pv, m\Delta N\}}{\Delta Pv}$$

$$Pd'' = \frac{\{(l+1)\Delta Pv - Pv\} f\{l\Delta Pv, (m+1)\Delta N\}}{\Delta Pv} \quad (5)$$

$$+ \frac{(Pv - l\Delta Pv) f\{(l+1)\Delta Pv, (m+1)\Delta N\}}{\Delta Pv}$$

$$Pd = \frac{\{(m+1)\Delta N - N\} Pd' + (N - m\Delta N) Pd''}{\Delta N} \quad (6)$$

Furthermore, the inventors have found the fact that if the following equations (7) and (8) are introduced to compensate the calculated value of the above equation (6) in accordance with the atmospheric pressure and the temperature of sucked air, the compensated value will serve to determine the pneumatic pressure at a higher reliable value.

$$Pd' = Pa/760 \cdot Pd \ldots \quad (7)$$

where the character Pa indicates a compensation value, and the character Pd' indicates a compensated pneumatic pressure.

$$Pd = 293/(273+t) \cdot Pd' \ldots \quad (8)$$

where the character t indicates the temperature of sucked air (° C.), and the character indicates a compensated pneumatic pressure.

It is, therefore, a primary object of the present invention to provide an electronic control system for a carburetor in which the above-noted function is effectively utilized to ensure optimum fuel-to-air ratio of mixture in accordance with operating conditions of the engine.

According to the present invention there is provided an electronic control system for a carburetor adapted to an internal combustion engine, the carburetor including an air induction passage with a venturi portion, a fuel passage supplying fuel from a float chamber into the venturi portion and an air passage permitting the flow of air into the fuel passage to be mixed with the fuel, the control system comprising:

- a pneumatically operated servo-motor to be operated by pneumatic pressure applied thereto;
- flow control means associated with the servo-motor for controlling the flow quantity of air through the air passage in accordance with changes of the pneumatic pressure applied to the servo-motor;
- first means for producing a first electric binary signal indicative of rotational speed of the engine;
- second means for producing a second electric binary signal indicative of intake manifold vacuum of the engine;
- third means for detecting pneumatic pressure applied to the servo-motor to produce an electric signal indicative of the pneumatic pressure;
- a digital computer for repetitively calculating a value indicative of optimum pneumatic pressure to be applied to the servo-motor in accordance with the first and second binary signals, the computer being programmed to calculate the optimum value from a function describing a desired relationship among optimum pneumatic pressure, rotational speed and intake manifold vacuum of the engine;
- a digital-to-analog converter for converting an electric binary signal indicative of the calculated optimum value into an electric analog signal;
- a drive circuit for comparing a level of the electric signal from the third means with first and second levels derived from the electric analog signal to produce a first output signal therefrom when the first level is higher than the level of the electric signal from the third means and to produce a second output signal therefrom when the second level is lower than the level of the electric signal from the third means, the drive circuit ceasing the output signal when the level of the electric signal from the third means is between the first and second levels; and first and second electrically operated valves to selectively apply intake manifold vacuum and the atmospheric pressure respectively from the engine and the exterior to the servo-motor when energized in response to one of the first and second output signals from the drive circuit.

BRIEF DESCRIPTION OF THE DRAWINGS

Additional objects and advantages of the present invention will be more readily apparent from the following detailed description of preferred embodiments thereof when taken together with the accompanying drawings in which.

DESCRIPTION OF THE PREFERRED EMBODIMENTS

Figure 1:
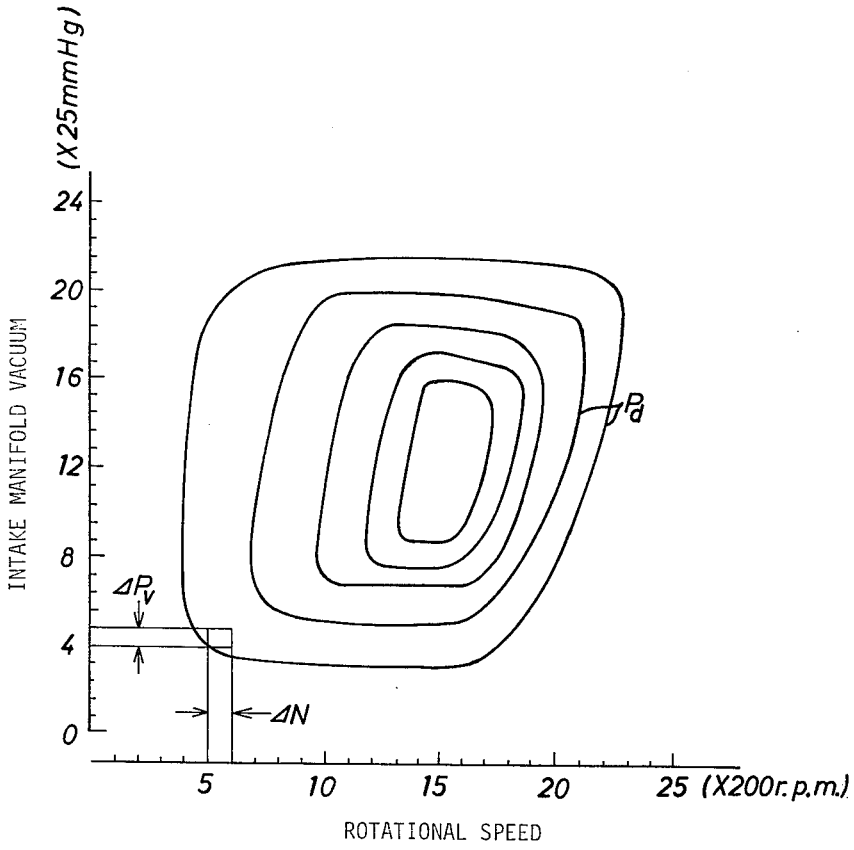
FIG. 1 is a graph illustrating pneumatic pressure in relation to rotational speed and intake manifold vacuum of an internal combustion engine.
Figure 2:
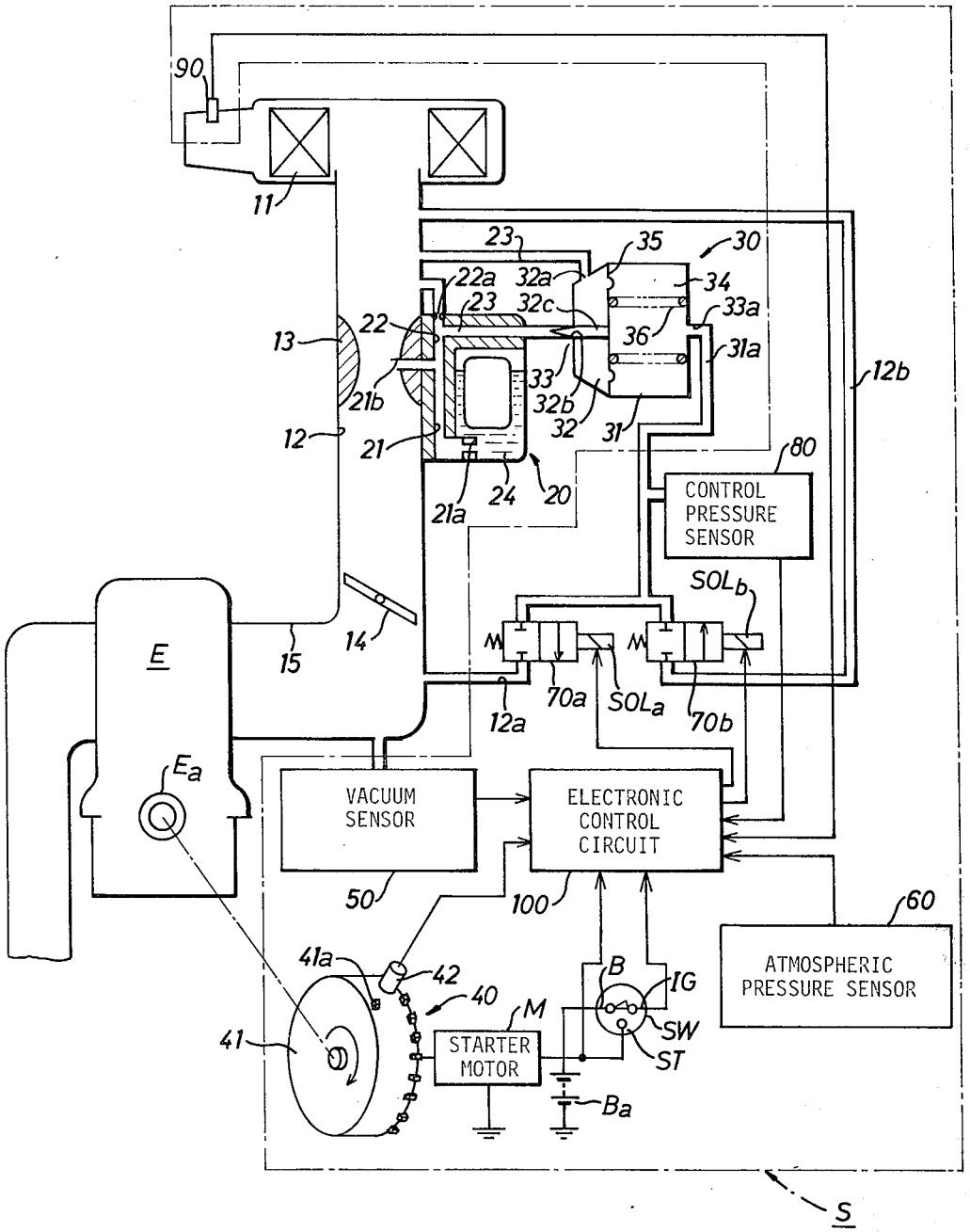
FIG. 2 illustrates an electronic control system in accordance with the present invention which is adapted to a carburetor for the engine.

Referring now to the drawings, particularly in FIG. 2 there is illustrated a carburetor 20 adapted to an internal combustion engine E for an automotive vehicle. The carburetor 20 includes an induction passage 12 through which the air from an air cleaner 11 flows into an intake manifold 15 of the engine E. The induction passage 12 is provided therein with a venturi portion 13 into which a fuel injection nozzle **21*b* opens and with a throttle valve 14 located at the downstream of venturi portion 13. The fuel injection nozzle 21*b* communicates into a float chamber 24 through a fuel passage 21 and a fuel jet 21*a*. The carburetor 20 further includes a primary air passage 22 in communication with the fuel passage 21 and a secondary air passage 23 in communication with the primary air passage 22. The primary air passage 22 communicates through an air jet 22*a* to the induction passage 12 at the upstream of venturi portion 13, and the secondary air passage 23 communicates through a servo motor 30 to the induction passage 12 at the upstream of venturi portion 13**.

The servo motor 30 includes a diaphragm member 35 assembled within a housing 31 to form an atmospheric chamber 32 and a servo chamber 34. The atmospheric chamber 32 has an inlet port **32*a* opening into the upstream of air passage 23 and an outlet port 32*b* opening into the downstream of air passage 23, while the servo chamber 34 has an inlet port 33*a* connected through a passage 31*a* to a pair of normally closed solenoid valves 70*a* and 70*b*. The diaphragm member 35 includes a needle valve member 32*c* centrally fixed thereto and is biased by a compression spring 36 toward the outlet port 32*b*. Thus, the needle valve member 32*c* cooperates with the outlet port 32*b* to provide a control valve 33. The opening degree of control valve 33 is controlled by the biasing force of spring 36 and a difference between the atmospheric pressure in the chamber 32 and a pneumatic pressure applied into the servo chamber 34 through the passage 31*a***.

The solenoid valve **70*a* has an inlet port in communication with the servo chamber 34 through the passage 31*a* and an outlet port in communication with the induction passage 12 through a passage 12*a*. When energized, the solenoid valve 70*a* acts to connect the passage 12*a* to the passage 31*a*. The solenoid valve 70*b* has an inlet port in communication with the upstream of venturi portion 13 through a passage 12*b* and an outlet port in communication with the servo chamber 34 through passage 31*a*. When energized, the solenoid valve 70*b* acts to connect the passage 12*b* to the passage 31*a*. The energization of respective solenoid valves 70*a* and 70*b* is under the control of an electronic control system of the present invention which includes an electronic control circuit 100 for generating control signals therefrom in response to output signals from an ignition switch SW, a speed sensor 40, a vacuum sensor 50, an atmospheric pressure sensor 60, a control pressure sensor 80 and a thermo-sensor 90**.

Figure 8:
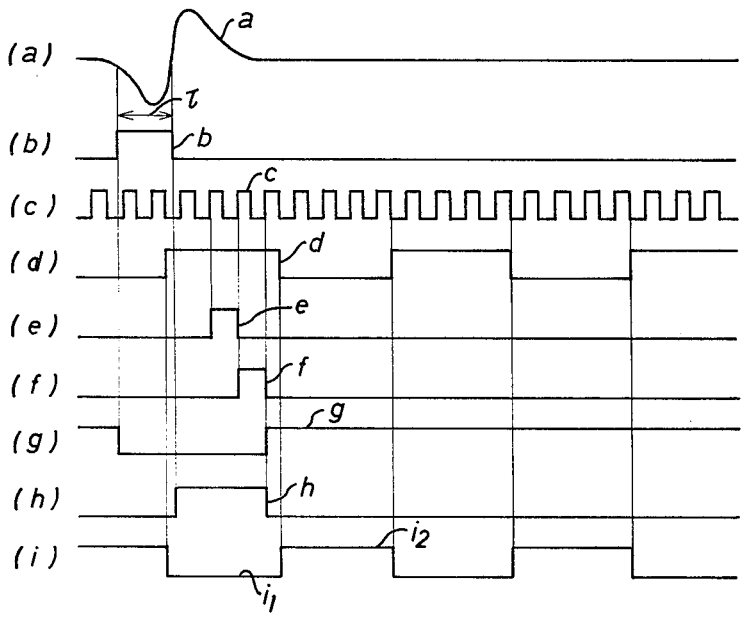
FIG. 8 illustrates waveforms obtained at various points in the circuit diagram of FIG. 5.

When the ignition switch SW is operated to provide a connection between contacts B and IG, the electronic control circuit 100 is activated by a DC voltage from a source of electricity in the form of a conventional automotive type storage battery Ba. When the ignition switch SW is subsequently operated to provide a connection between contacts B and ST, a starter motor M of the engine E is temporarily driven. The speed sensor 40 is a magnetic pickup type detector which includes a magnetic pickup transducer 42 in magnetic coupling relationship with a projection **41*a* on a ring gear 41. The ring gear 41 is driven by a crankshaft Ea of the engine E and rotates once at one crankshaft rotation. During rotation of the crankshaft Ea, the transducer 42 detects the angular position of projection 41*a* at each rotation of ring gear 41 to produce an electric signal indicative of rotational speed of the engine E, as shown in FIG. 8**.

The vacuum sensor 50 is provided on the intake manifold 15 to detect engine intake manifold vacuum, producing an electric signal indicative of the intake manifold vacuum. The atmospheric pressure sensor 60 is provided on a portion of the vehicle body structure to produce an electric signal indicative of a level of the atmospheric pressure. The control pressure sensor 80 is provided on a conduit of passage 31*a* between the servomotor 30 and the solenoid valves to detect pneumatic pressure in the passage 31*a*, producing an electric signal indicative of the pneumatic pressure. The thermo-sensor 90 is provided within the air cleaner 11 to detect the temperature of sucked air, producing an electric signal indicative of the sucked air temperature.

Figure 3:
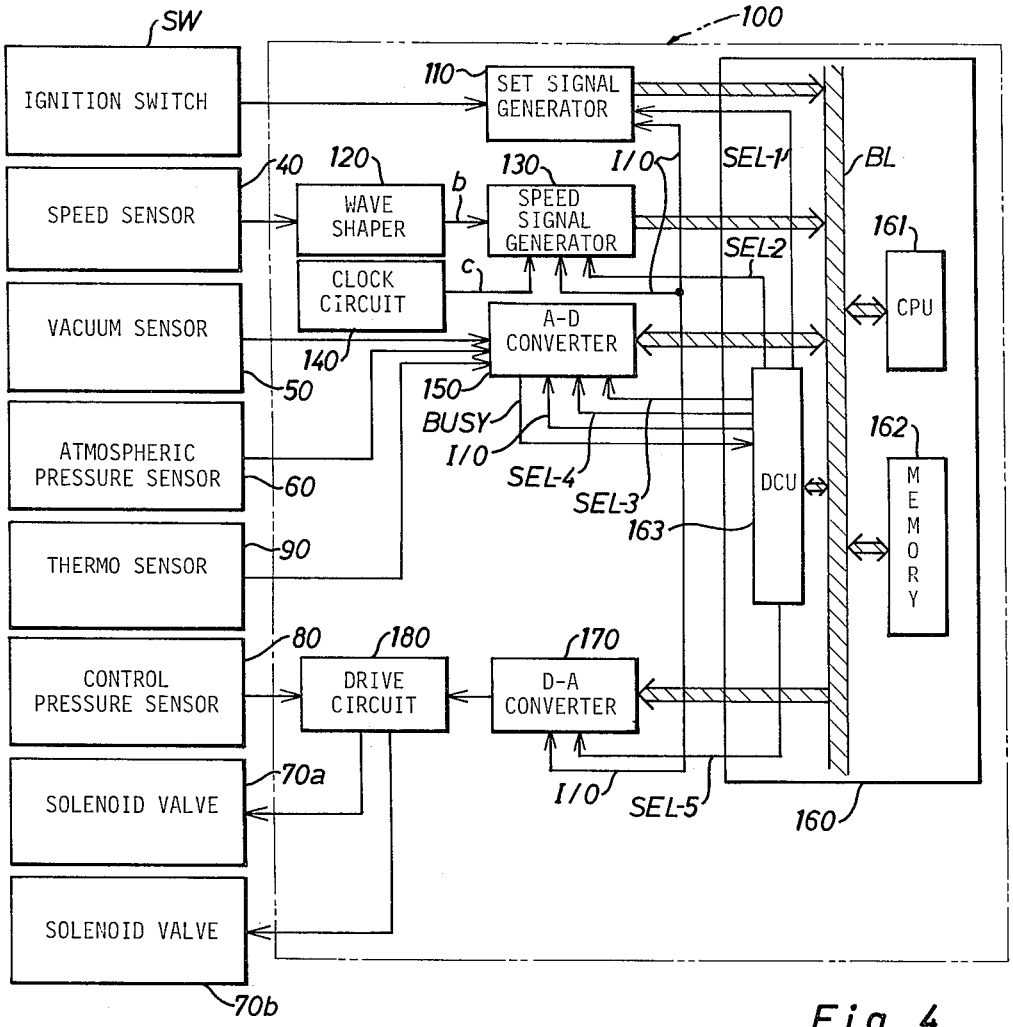
FIG. 3 is a schematic block diagram of the electronic control system shown in FIG. 2.

As shown in FIG. 3, the electronic control circuit 100 comprises a set signal generator 110 which produces a set signal in response to direct current across the ignition switch SW. The set signal is applied to a bus line BL of a digital computer 160 in response to an input-output or I/O signal and a first device-select or SEL-1 signal from the computer 160, as described later in detail. In the electronic control circuit 100, a wave shaper 120 is provided to reshape the electric signal a from speed sensor 40 into a square wave form pulse signal b, as shown in FIG. 8. The pulse signal b has a pulse-width $\tau$ and a period of time T corresponding with rotational speed of the engine E. A clock circuit 140 is a conventional crystal oscillator which serves to generate a series of clock pulses c at a predetermined frequency, as shown in FIG. 8. A speed signal generator 130 is coupled with the wave shaper 120 and the clock circuit 140 to calculate the period of time T of the pulse signal b in accordance with the clock pulses c. Then, the calculated resultant value is latched in the speed signal generator 130 and applied as a binary signal to the bus line BL of digital computer 160 in response to the I/O signal and a second device-select or SEL-2 signal from computer 160. An analog-to-digital conversion circuit 150 is operated by an output request signal from computer 160 to select one of input signals from vacuum sensor 50, atmospheric pressure sensor 60 and thermo-sensor 90 in response to the I/O signal, third and fourth device-select or SEL-3 and SEL-4 signals from computer 160 and subsequently converts the selected input signal into a binary signal. This binary signal is applied to the computer 160 through bus line BL.

The digital computer 160 is a commercially available computer of TLCS type manufactured by Tokyo Shibaura Electric Co., Ltd. in Japan. The digital computer 160 comprises a central processing unit or CPU 161, a memory 162, having a read-only memory and a random access memory, in connection with CPU 161 through bus line BL, and a device control unit or DCU 163. A predetermined program is previously stored in memory 162 such that CPU 161 calculates an optimum pneumatic pressure value Pd from the above-noted inequalities (2), (3) and equations (4) to (8) in accordance with the binary signals from speed signal generator 130 and analog-to-digital conversion circuit 150. It is also noted that the memory 162 stores therein the above-noted data indicative of a plurality of pneumatic pressure values f(l$\Delta$Pv, m$\Delta$N) in the form of the map. DCU 163 acts to produce therefrom the I/O signal, the SEL-1 to SEL-4 signals and a fifth device-select or SEL-5 signal by receiving a request signal from CPU 161. In accordance with proceeding of the program, the SEL-1 and I/O signals are applied to set signal generator 110, the SEL-2 and I/O signals are applied to speed signal generator 130, the SEL-3, 4 and I/O signals are applied to analog-to-digital conversion circuit 150, and the SEL-5 and I/O signals are applied to a digital-to-analog conversion circuit 170. Further detailed description regarding the digital computer is eliminated because the particular construction and programming process is well known in the prior arts.

The digital-to-analog conversion circuit 170 serves to convert the calculated optimum value from computer 160 into an electric analog voltage in response to the I/O and SEL-5 signals. The electric analog voltage is applied to a drive circuit 180 which compares the analog voltage with an output signal from control pressure sensor 80 to selectively produce first and second control signals.

Figure 4:
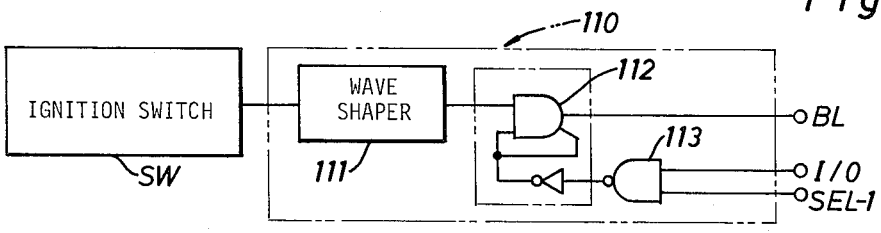
FIG. 4 is a circuit diagram of the set signal generator shown in block form in FIG. 3.

In FIG. 4, there is illustrated a preferred embodiment of the set signal generator 110 in which a three-state-buffer 112 is provided to transfer an output square wave form pulse from wave shaper 111 to the bus-line BL of computer 160 in response to an output signal from a NAND-gate 113. NAND-gate 113 acts to produce a low level signal therefrom in response to the I/O and SEL-1 signals of high level from DCU 163. When one of the I/O and SEL-1 signals becomes a low level signal, NAND-gate 113 produces a high level signal at its output terminal. The three-state-buffer 112 applies the output square wave form pulse from wave shaper 111 to the bus-line BL of computer 160 in response to the low level signal from NAND-gate 113. When received the high level signal from NAND-gate 113, the buffer 112 interrupts the output pulse from wave shaper 111 due to high impedance at its output terminal.

Figure 5:
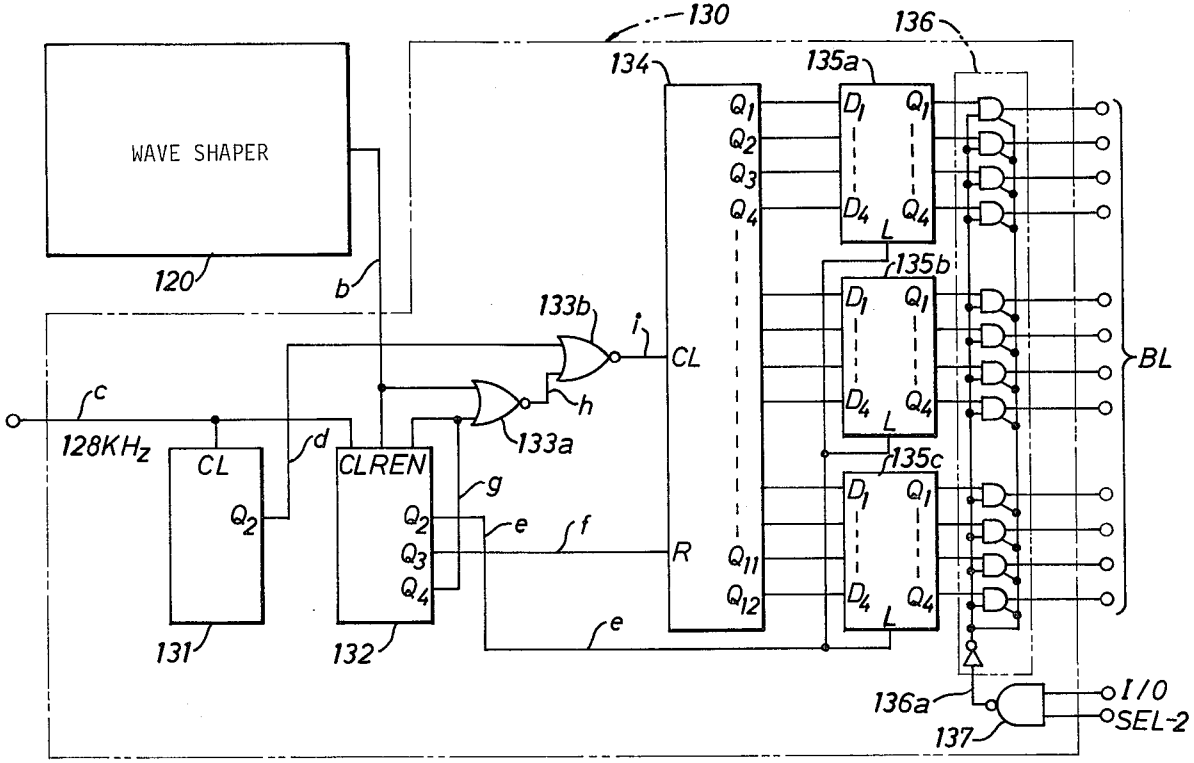
FIG. 5 is a circuit diagram of the speed signal generator shown in block form in FIG. 3.

FIG. 5 illustrates a preferred embodiment of the speed signal generator 130 which comprises a binary counter 131 having a clock terminal CL for receiving clock pulses c at a frequency of about 128 KHz from clock circuit 140. The binary counter 131 is of CD4024 type manufactured by RCA Corporation and serves to produce an electric signal d (See FIG. 8) at its output terminal $Q_2$ in accordance with the clock pulses c. The electric signal d is applied to a NOR-gate 133*b*. The speed signal generator 130 also comprises a decade counter 132 which has a reset terminal R for receiving the pulse signal b from wave shaper 120 and a clock terminal CL for receiving the clock pulses c from clock circuit 140. The decade counter 132 is reset in response to the pulse signal b and starts to count the clock pulses c at a trailing edge of the pulse signal b. Then, the counter 132 produces high level signals e, f and g in sequence at its output terminals $Q_2$, $Q_3$ and $Q_4$, as shown in FIG. 8. The high level signal e is applied to shift registers 135*a*, 135*b* and 135*c*, and the high level signal f is applied to a binary counter 134. The high level signal g is further applied to a NOR-gate 133*a* and to an inhibit terminal EN of counter 132 to inhibit the counting operation.

The NOR-gate 133*a* has input terminals for respectively receiving the high level signal g from counter 132 and the pulse signal b from wave shaper 120. When the signals g and b are in a low level respectively, NOR-gate 133*a* produces a high level signal h therefrom, as shown in FIG. 8. The NOR-gate 133*b* has input terminals for respectively receiving the electric signal d from binary counter 131 and the high level signal h from NOR-gate 133*a*. When received a high level signal from one of binary counter 131 and NOR-gate 133*a*, the NOR-gate 133*b* produces a low level signal $i_1$ therefrom. When received low level signals d and h from binary counter 131 and NOR-gate 133*a*, the NOR-gate 133*b* produces a high level signal $i_2$ therefrom. The low and high level signals $i_1$, $i_2$ are alternatively applied to a clock terminal CL of binary counter 134.

The binary counter 134 is reset in response to a high level signal f from decade counter 132 and starts to count a series of high level signals $i_2$ from NOR-gate 133*b* at trailing edge of the high level signal f. The counting operation is completed at a trailing edge of an electric pulse signal b which will be produced from wave shaper 120 after generation of the high level signal f. In other words, the counting operation of binary counter 134 starts at the trailing edge of the high level signal f and is completed at the leading edge of a high level signal h which will be produced from NOR-gate 133*a* after generation of the high level signal f. As a result, the binary counter 134 produces output signals respectively at its terminals $Q_1$ and $Q_{12}$ as an electric binary signal indicative of the period of time T of the pulse signal b, the period of time T being proportional to a reciprocal of rotational speed N of the engine E.

The shift registers 135*a*, 135*b* and 135*c* are respectively of CD 4035 type manufactured by RCA Corporation. The shift register 135*a* has a clock or latch terminal L for receiving the electric signal e from decade counter 132 and input terminals $D_1$ to $D_4$ for respectively receiving the output signals from the terminals $Q_1$ to $Q_4$ of binary counter 134. When the electric signal e appears at the output terminal $Q_2$ of decade counter 132, the register 135*a* latches therein the output signals from binary counter 134 which are previously counted prior to generation of the electric signal e. The remaining shift registers 135*b* and 135*c* have substantially the same construction and function as those of shift register 135*a*. Thus, all the output signals from binary counter 134 are simultaneously latched as the binary signals by the shift registers 135*a*, 135*b* and 135*c*.

The speed signal generator 130 further comprises a three-state-buffer 136 which has a control terminal 136*a* for receiving an electric signal from NAND-gate 137 and input terminals for receiving the output signals from shift registers 135*a*, 135*b* and 135*c*. The NAND-gate 137 has input terminals for receiving the I/O and SEL-2 signals from computer 160 respectively. When both the I/O and SEL-2 signals are in a high level, NAND-gate 137 produces a low level signal therefrom. When one of the I/O and SEL-2 signals becomes a low level signal, NAND-gate produces a high level signal therefrom. Upon receiving the low level signal from NAND-gate 137, the three-state-buffer 136 acts to transfer the binary output signals from shift registers to the bus-line BL of computer 160. When received the high level signal from NAND-gate 137, the buffer 136 acts to interrupt the computer 160 from shift registers due to high impedance at its output terminals.

Figure 6:
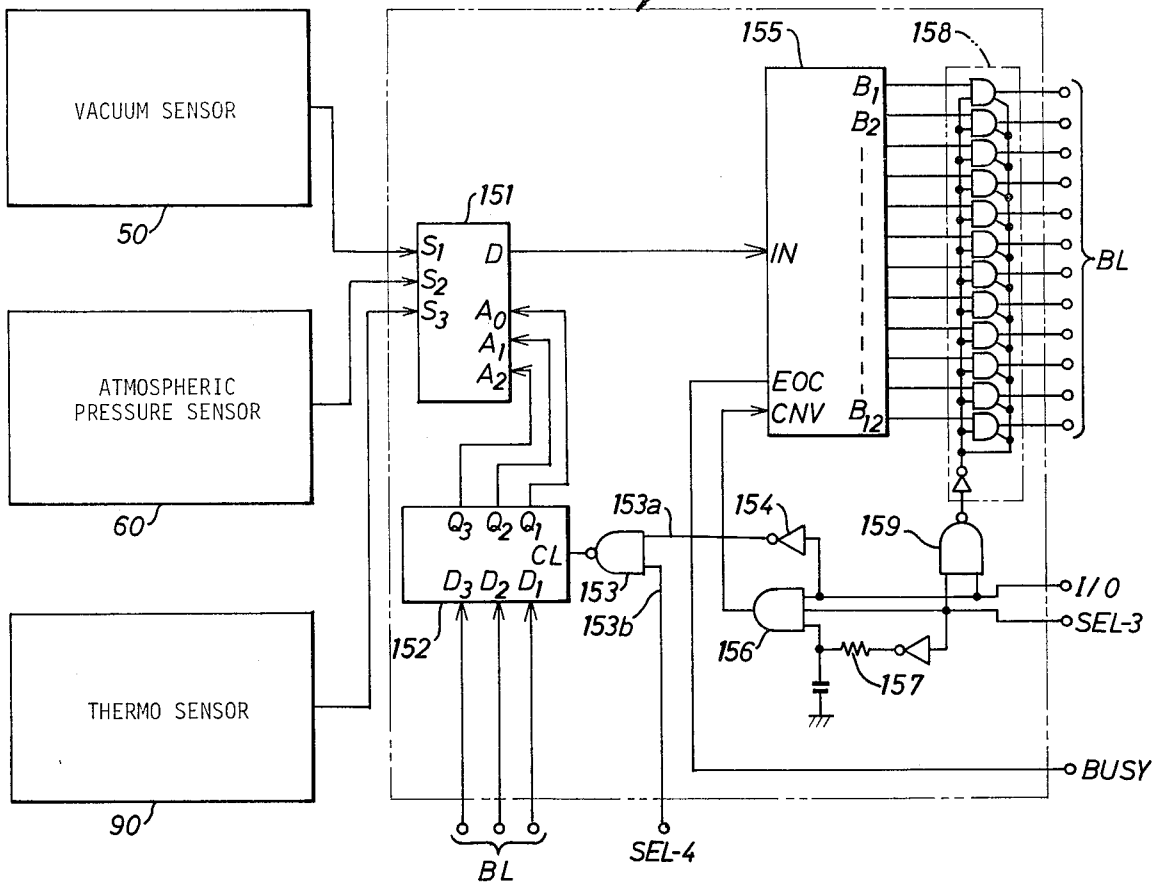
FIG. 6 is a circuit diagram of the analog-to-digital conversion circuit shown in block form in FIG. 3.

FIG. 6 illustrates a preferred embodiment of the analog-to-digital conversion circuit 150 which includes an analog multiplexer 151 controlled by a shift register 152 in response to an output signal from a NAND-gate 153. NAND-gate 153 has a first input terminal 153*a* for receiving the I/O signal from computer 160 through an inverter 154 and a second input terminal 153*b* for receiving the SEL-4 signal from computer 160. When the binary output signals from analog-to-digital conversion circuit 150 and requested by CPU 161 of computer 160 under the program of memory 162, the I/O signal becomes a low level signal, and the SEL-4 signal becomes a high level signal. The low level I/O signal is inverted by inverter 154 so that the NAND-gate 153 produces a low level signal at its output terminal. When CPU 161 of computer 160 does not request the binary output signals from analog-to-digital conversion circuit 150, the I/O signal becomes a high level signal, and then the NAND-gate 153 produces a high level signal at its output terminal.

When received the low level signal from NAND-gate 153, the shift register 152 is reset to latch three kinds of binary select signals from computer 160. The latched select signals act to selectively connect three input terminals $S_1$, $S_2$, $S_3$ of multiplexer 151 to an output terminal D. When the multiplexer 151 receives the latched select signals at its control terminals $A_0$, $A_1$, $A_2$, any one of the input terminals $S_1$, $S_2$, $S_3$ is connected to the output terminal D so that any one of the output signals from sensors 50, 60 and 90 appears at the output terminal D. In addition, the multiplexer 151 is of DG 508 type manufactured by Intersil Inc. in U.S.A.

Figure 9:
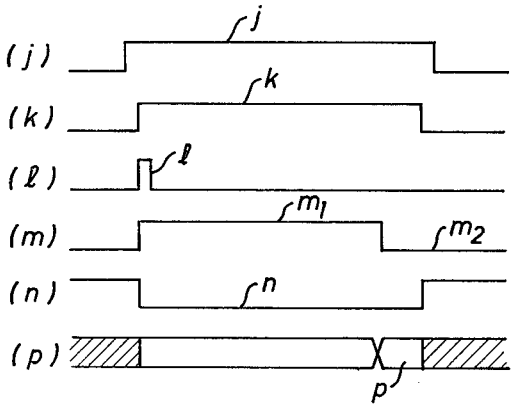
FIG. 9 illustrates waveforms obtained at various points in the circuit diagram of FIG. 6.

The analog-to-digital conversion circuit 150 further includes a successive approximation analog-to-digital converter 155 controlled by an AND-gate 156 and a three-state-buffer 158 controlled by a NAND-gate 159. AND-gate 156 has first and second input terminals for respectively receiving the I/O and SEL-3 signals from computer 160. AND-gate 156 is also provided with a third input terminal for receiving the SEL-3 signal through a delay circuit 157 including a condenser, a resistor and an inverter. When the I/O and SEL-3 signals are respectively high level signals j, k, as shown in FIG. 9, AND-gate 156 produces therefrom an electric pulse signal having a pulse-width of about 100 nanoseconds. NAND-gate 159 has input terminals for receiving the I/O and SEL-3 signals from computer 160. When the I/O and SEL-3 signals are respectively high level signals j, k, NAND-gate 159 produces a low level signal therefrom. When one of the I/O and SEL-3 signals becomes a low level signal, NAND-gate 159 produces a high level signal therefrom.

The analog-to-digital converter 155 is a converter of ADC 80 type manufactured by Burr-Brown Research Corporation which includes an input terminal IN for receiving the electric signal from multiplexer 151, a convert-command input terminal CNV for receiving the pulse signal from AND-gate 156 and and end-of-conversion output terminal EOC for applying an electric signal to computer 160. When AND-gate 156 produces the pulse signal therefrom, the converter 155 initiates at the leading edge of pulse signal to convert the electric signal from multiplexer 151 into a binary signal. Simultaneously, a high level signal $m_1$ appears at the output terminal EOC and is applied as a BUSY signal to DCU 163 of computer 160. Thus, the computer 160 is ready to read out the binary signal supplied from the converter 155 through the three-state buffer 158. During the operation of converter 155, NAND-gate 159 produces a low level signal therefrom due to the I/O and SEL-3 signals of high level. When BUSY signal becomes a low level signal, the operation of converter 155 ceases, and subsequently the three-state-buffer 158 supplies the binary signal from converter 155 to computer 160 in response to the low level signal from NAND-gate 159 within a period of time indicated by the character p in FIG. 9. When both the I/O and SEL-3 signals become low level signals respectively, high impedance appears at the output terminal of three-state-buffer 158 to electrically disconnect the computer 160 from the converter 155.

Figure 7:
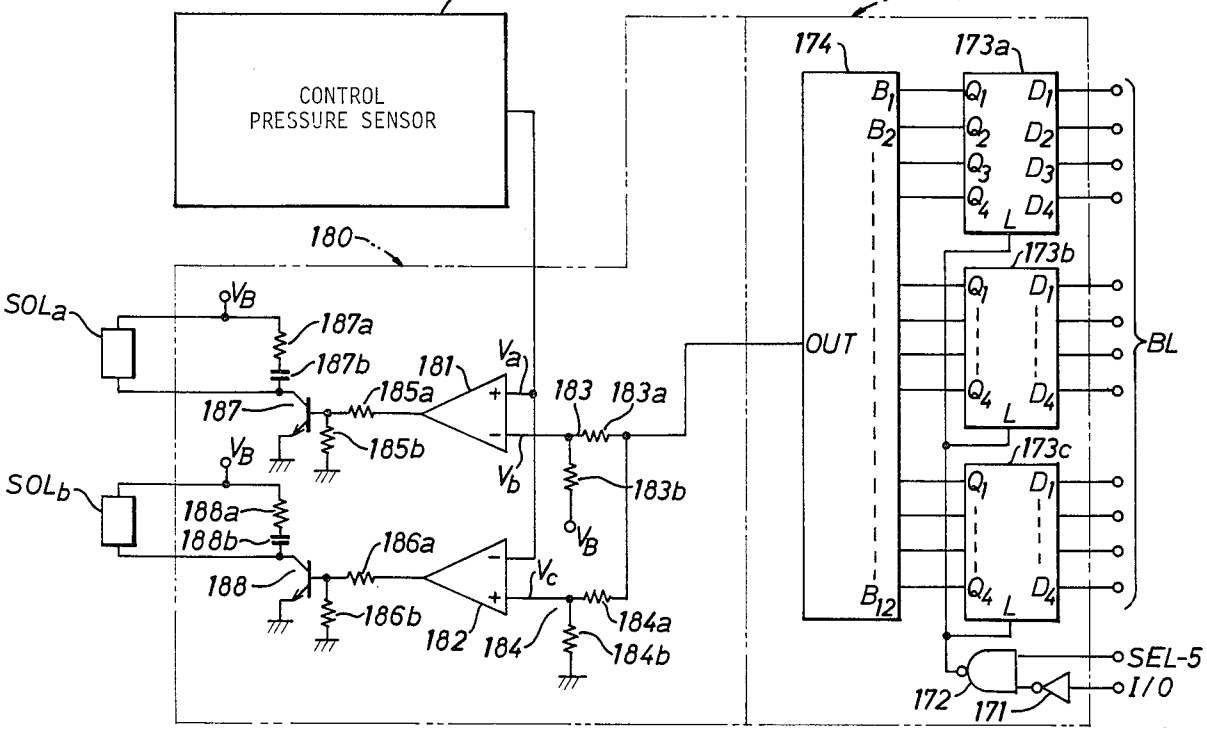
FIG. 7 is circuit diagrams of the digital-to-analog conversion circuit and drive circuit respectively shown in block forms in FIG. 3.

In FIG. 7 there are illustrated preferred embodiments of the digital-to-analog conversion circuit 170 and the drive circuit 180. The conversion circuit 170 includes shift registers 173*a*, 173*b* and 173*c* which are controlled by a NAND-gate 172. NAND-gate 172 has a first input terminal for receiving the SEL-5 signal from computer 160 and a second input terminal for receiving an inverted signal from an inverter 171. The inverter 171 acts to invert the I/O signal from computer 160 into the inverted signal. When NAND-gate 172 receives the SEL-5 signal of low level and the I/O signal of high level at its input terminals in response to a request signal from computer 160, a low level signal appears at the output terminal of NAND-gate 172 and is applied to the respective shift registers 173*a*, 173*b* and 173*c*. When the computer 160 does not issue any request signal therefrom, a high level signal appears at the output terminal of NAND-gate 172.

Each of the shift registers 173*a*, 173*b* and 173*c* acts to latch binary signals from computer 160 in response to the low level signal from NAND-gate 172. The latched binary signals are received by a digital-to-analog converter 174, which is a commercially available converter of DAC 80 type manufactured by Burr-Brown Research Corporation. The converter 174 acts to convert the latched binary signals from shift registers 173*a*, 173*b*, 173*c* into an electric analog signal. The drive circuit 180 comprises a pair of comparators 181, 182 and a pair of power transistors 187, 188 under the control of respective comparators 181, 182.

The comparator 181 has a first input terminal for receiving the electric signal Va from control pressure sensor 80 and a second input terminal for receiving the analog voltage from converter 174 through a voltage divider 183. The voltage divider 183 includes resistors 183*a* and 183*b* to divide a difference between the analog voltage from converter 174 and an electric power source voltage $V_B$ into a divided voltage Vb. When the level of the divided voltage Vb is higher than that of the electric signal voltage Va, the comparator 181 produces a low level signal at its output terminal. When the level of the divided voltage Vb is lower than that of the electric signal voltage Va, the comparator 181 produces a high level signal at its output terminal. The power transistor 187 is connected at its base to the output terminal of comparator 181 through input and bias resistors 185*a* and 185*b*. The collector of transistor 187 is connected to the electric power source $V_B$ through an electric magnetic coil SOLa of solenoid valve 70*a*, the coil being connected in parallel with a resistor 187*a* and a condenser 187*b*. Upon receiving the low level signal from comparator 181, the power transistor 187 is turned off to deenergize the solenoid valve 70*a*. The transistor 187 is turned on in response to the high level signal from comparator 181 to energize the solenoid valve 70*a*.

The comparator 182 has a first input terminal for receiving the electric signal Va from control pressure sensor 80 and a second input terminal for receiving the analog voltage from converter 174 through a voltage divider 184. The voltage divider 184 includes resistors 184*a* and 184*b* to divide the analog voltage from converter 174 into a divided voltage Vc. When the level of the divided voltage Vc is higher than that of the electric signal voltage Va, the comparator 182 produces a high level signal at its output terminal. When the level of the divided voltage Vc is lower than that of the electric signal voltage Va, the comparator 182 produces a low level signal at its output terminal. The power transistor 188 is connected at its base to the output terminal of comparator 182 through input and bias resistors 186*a* and 186*b*. The collector of transistor 188 is connected to the electric power source $V_B$ through an electric magnetic coil SOLb, the coil being connected in parallel with a resistor 188*a* and a condenser 188*b*. Upon receiving the high level signal from comparator 182, the power transistor 188 is turned on to energize the solenoid valve 70*b*. The transistor 188 is turned off in response to the low level signal from comparator 182 to deenergize the solenoid valve 70*b*.

In the above embodiment, it should be recognized that the divided voltage Vc is determined to be lower than the divided voltage Vb by a predetermined value (For instance, 10 mmHg). Thus, the predetermined difference between the divided voltages Vc and Vb serves to provide non-sensitive areas as indicated by a dotted line and a dot-dash line in FIG. 10. As a result, both the solenoid valves 70*a* and 70*b* may not be opened at the same time to prevent relative interference between the solenoid valves 70*a* and 70*b*. This eliminates unstable operation of the respective solenoid valves.

Figure 10:
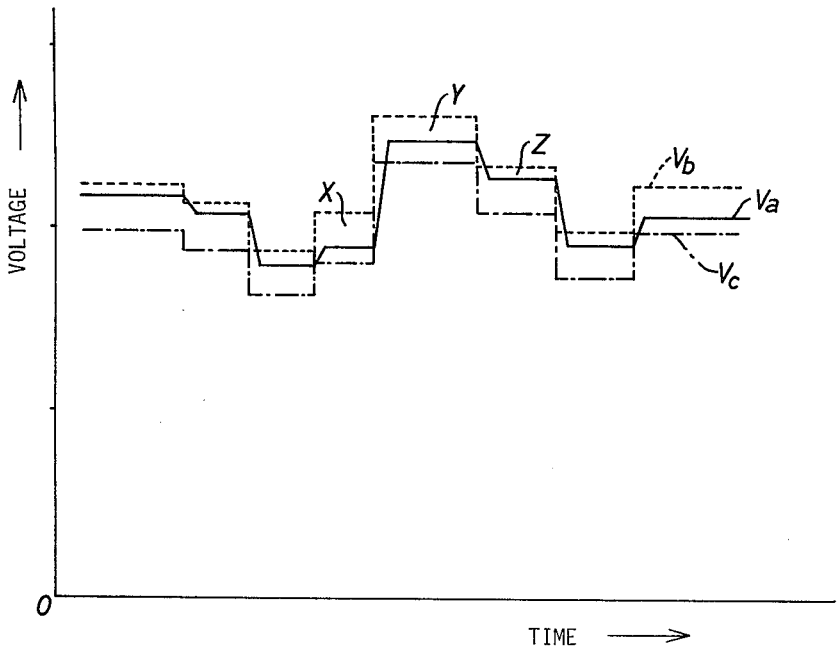
FIG. 10 is a graph showing operative characteristics of the drive circuit in relationship between electric voltage and lapse of time.

Assuming that the operation of servo motor 30 is conducted at an area indicated by the character X in FIG. 10, the electric signal voltage Va from control pressure sensor 80 is lower than the divided voltage Vb and higher than the divided voltage Vc. Under this condition, each of the comparators 181 and 182 produces a low level signal therefrom to make each of the power transistors 187 and 188 non-conductive, and both the solenoid valves 70*a* and 70*b* are deenergized so that the pressure in servo chamber 34 is maintained in a value. If the operative condition of servo motor 30 is subsequently transferred from the area X to an area Y in FIG. 10, the electric signal voltage Va at the area X becomes lower than both the divided voltages Vb and Vc at the area Y. Then, the solenoid valve 70*a* is still deenergized and only the solenoid valve 70*b* is energized by a high level signal from comparator 182 so that the pressure in servo chamber 34 becomes the atmospheric pressure. Thus, the electric signal voltage Va reaches the divided voltage Vc, and the comparator 182 produces a low level signal therefrom to make the power transistor 188 non-conductive. This results in deenergization of the solenoid valve 70*b*. In this instance, if the closing operation of solenoid valve 70*b* is delayed, the signal voltage Va will overshoot at the area Y. It is, however, noted that the signal voltage Va does not reach the divided voltage Vb due to the non-sensitive area described above.

When the operative condition of servo motor 30 is transferred from the area Y to an area Z in FIG. 10, the electric signal voltage Va at the area Y becomes higher than both the divided voltages Vb and Vc. Under this condition, the solenoid valve 70*b* is still closed and only the solenoid valve 70*a* is energized by a high level signal from comparator 181 so that the pressure in servo chamber 34 becomes negative pressure. Then, the electric signal voltage Va reaches the divided voltage Vb at the area Z, and the comparator 181 produces a low level signal therefrom to make the power transistor 187 non-conductive. This results in deenergization of the solenoid valve 70*a*. In this instance, if the closing operation of solenoid valve 70*a* is delayed, the signal voltage Va will undershoot at the area Z. It is, however, noted that the signal voltage Va does not reach the divided voltage Vc due to the non-sensitive area described above.

OPERATION

Figure 11:
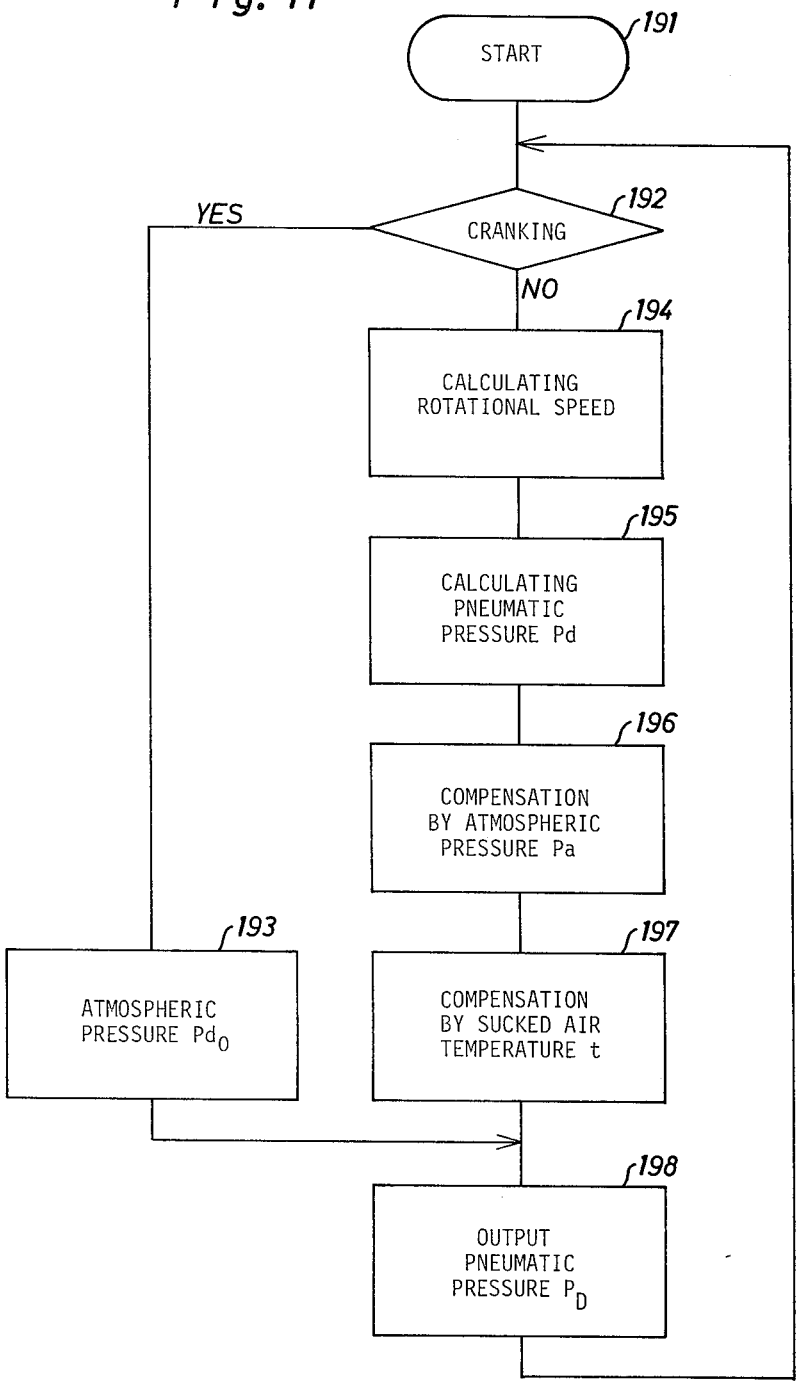
FIG. 11 is a flow chart illustrative of the operation of the digital computer.

With reference to a flow chart of FIG. 11, the mode of operation of the above embodiment will be described hereinafter. When the ignition switch SW is closed to provide a connection between contacts B and IG, the electronic control circuit 100 is activated to initiate execution of the computer program at a point 191 shown in the flow chart. During cranking operation of the engine, at a point 192, CPU 161 of computer 160 receives a set signal from set signal generator 110 in response to I/O and SEL-1 signals from DCU 163, and then the program proceeds to the next point 193. Upon completion of reading the set signal, a predetermined pneumatic pressure value $Pd_0$ stored in memory 162 is read out by CPU 161 in response to the I/O and SEL-5 signals, and an output data from CPU 161 is applied to the digital-to-analog conversion circuit 170 at a point 198. Then, the output data from CPU 161 is converted into an electric analog voltage and applied to the drive circuit 180. When the comparator 181 of drive circuit 180 receives an electric signal voltage Va from pressure control sensor 80 and a divided voltage Vb higher than the signal voltage Va, the power transistor 187 is turned off to deenergize the solenoid valve 70*a*. On the other hand, the comparator 182 of drive circuit 180 receives the signal voltage Va and a divided voltage Vc higher than the signal voltage Va to produce a high level signal therefrom. Thus, the power transistor 188 is turned on by the high level signal from comparator 182 to energize the solenoid valve 70*b*. Consequently, the atmospheric pressure is applied to the servo chamber 34 of motor 30 from the upstream of venturi 13 through passages 12*b* and 31*a* so that the control valve 33 is closed due to the biasing force of spring 35.

Under the above condition, the air from air cleaner 11 flows into venturi portion 13 and into primary air passage 22 through air jet 22*a*, while fuel from float chamber 24 is drawn into fuel passage 21 through fuel jet 21*a*. The bleed air in passage 22 is mixed with the fuel in passage 21, and the air-fuel mixture is drawn into venturi portion 13 from nozzle 21*b*. The air fule mixture is further mixed with the air in venturi portion 13 and enters into the combustion chamber of engine E through throttle valve 14 at a proper fuel-to-air ratio.

If there is no set signal from set signal generator 110 at the point 192 after the cranking operation, the start of engine E is discriminated by CPU 161 so that the program proceeds to a point 194. At the point 194, a binary signal indicative of a period of time from speed signal generator 130 is entered into computer 160 in response to the I/O and SEL-2 signals and converted by CPU 161 into a binary signal indicative of the engine speed N which is temporarily memorized in memory 162. In accordance with proceeding of the program to a point 195, an output request signal from CPU 161 is applied to the analog-to-digital conversion circuit 150 so that a binary signal indicative of an intake manifold vacuum Pv is entered into computer 160 from the analog-to-digital conversion circuit 150 in response to the I/O, SEL-3 and SEL-4 signals. Subsequently, the values of the above-noted integers l and m are respectively determined by CPU 161 from the programmed inequalities (2) and (3) in relation to the engine speed N and the intake manifold vacuum Pv. Thereafter, CPU 161 reads out respective values $f(l\Delta Pv, m\Delta N)$, $f\{(l+1)\Delta Pv, m\Delta N\}$, $f\{l\Delta Pv, (m+1)\Delta N\}$ and $f\{(l+1)\Delta Pv, (m+1)\Delta N\}$ from memory 162 in relation to the values of the integers l, m. Thus, the respective values Pv, N, l, m, $\Delta Pv$, $\Delta N$ are used by CPU 161 to calculate a value indicative of optimum pneumatic pressure Pd under 760 mmHg at 20° C. from the programmed equations (4), (5) and (6).

When the program proceeds to points 196 and 197 after completion of the above calculation, request signals from CPU 161 are subsequently applied to the analog-to-digital conversion circuit 150 so that a binary signal indicative of the atmospheric pressure Pa and a binary signal indicative of the temperature t of sucked air are subsequently entered into computer 160 from the analog-to-digital conversion circuit 150 in response to the I/O, SEL-3 and SEL-4 signals. Then, the resultant value of the above calculation is compensated by calculations of the above-noted equalities (7) and (8) in relation to the atmospheric pressure Pa and the temperature t of sucked air. The compensated resultant value is applied at a point 198 to the digital-to-analog conversion circuit 170 in response to the I/O and SEL-5 signals. Thus, the compensated resultant value is converted into an electric analog voltage and applied to the drive circuit 180.

When the comparator 181 of drive circuit 180 receives an electric signal voltage Va from pressure control sensor 80 and a divided voltage Vb lower than the signal voltage Va, the power transistor 187 is turned on by a high level signal from comparator 181 to energize the solenoid valve 70*a*. On the other hand, the comparator 182 of drive circuit 180 receives the signal voltage Va and a divided voltage Vc lower than the signal voltage Va to produce a low level signal therefrom. Thus, the power transistor 188 is turned off by the low level signal from comparator 182 to deenergize the solenoid valve 70*b*. Consequently, the servo chamber 34 of motor 30 is disconnected from passage 12*b*, and the intake manifold vacuum is applied to the servo chamber 34 from the downstream of throttle valve 14 through passages 12*a* and 31*a* so that the control valve 33 is opened by retraction of diaphragm member 35 against spring 36.

Under this condition, the air from air cleaner 11 flows into venturi portion 13 and into primary and secondary air passages 22 and 23, while fuel from float chamber 24 is drawn into fuel passage 21 through fuel jet 21*a*. The bleed air from passage 22 and the air from passage 23 are mixed with the fuel in passage 21, and the air-fuel mixture is drawn into venturi portion from nozzle 21*b*. The air-fuel mixture is further mixed with the air in venturi portion 13 and enters into the combustion chamber of engine E through throttle valve 14 at a proper fuel-to-air ratio.

Figure 12:
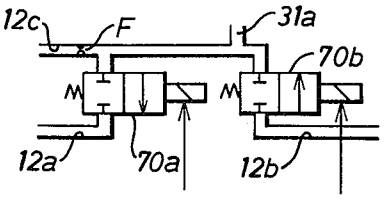
Figure 13:
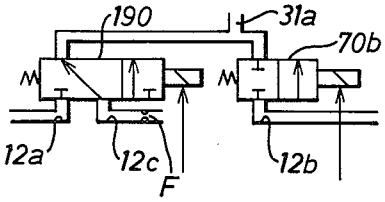

In FIG. 12 there is illustrated a modification of the present invention in which the passage 31*a* between servo motor 30 and solenoid valve 70*a* is provided with an additional passage 12*c* which is in open communication with the upstream of venturi portion 13. The additional passage 12*c* includes a fixed orifice F to throttle the atmospheric air flowing into passage 31*a* from the upstream of venturi portion 13. FIG. 13 illustrates another modification of the present invention in which the solenoid valve 70*a* is replaced with a solenoid valve 190. The solenoid valve 190 has a first inlet port in open communication with the downstream of throttle valve 14 through passage 12*a* and a second inlet port in open communication with the upstream of venturi portion 13 through passage 12*c*. The passage 12*c* corresponds with passage 12*c* of FIG. 12. With the above modifications, the fixed orifice F serves to avoid undesired overshooting or undershooting operation of the respective solenoid valves and to ensure more accurate control of the pneumatic pressure in servo motor 30.

Figure 14:
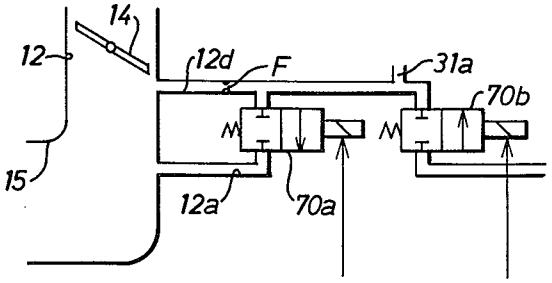
FIGS. 12 to 14 respectively illustrate partial modifications of the electronic control system shown in FIG. 2.
Figure 15:
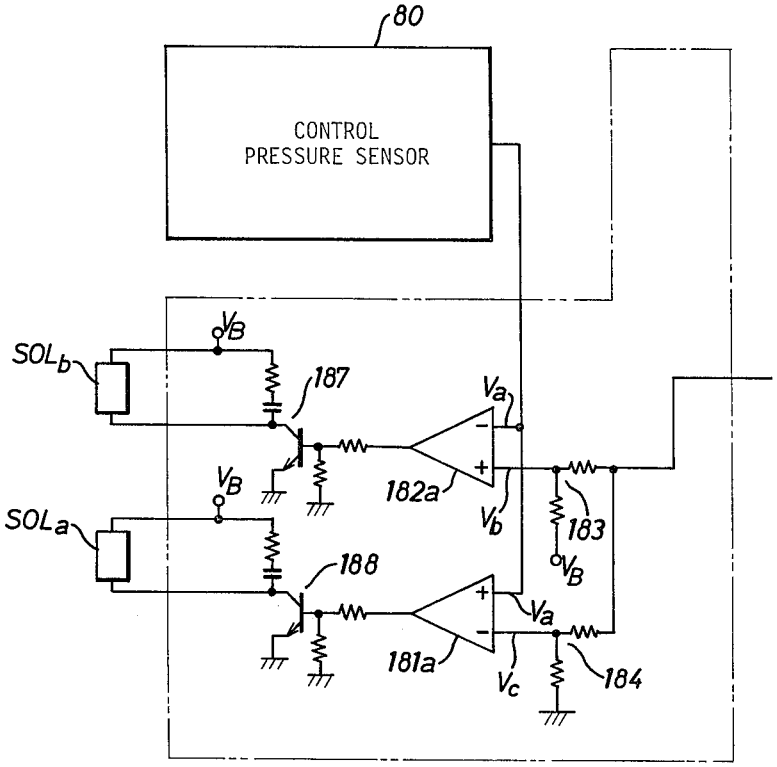
FIG. 15 illustrates a modification of the drive circuit shown in block form in FIG. 3.

In practice of the present invention, the passage 31*a* between servo motor 30 and solenoid valve 70*a* may be connected to an additional passage 12*d* as shown in FIG. 14. The passage 12*d* communicates with the downstream of throttle valve 14 and is provided therein with a fixed orifice F. To control the operation of solenoid valves 70*a* and 70*b*, the drive circuit 180 may be modified as shown in FIG. 15. In a modified drive circuit of FIG. 15, the comparators 181 and 182 of FIG. 7 are replaced with comparators 182*a* and 181*a* respectively, and the power transistors 187 and 188 are connected to the magnetic coil SOLb and SOLa respectively. With this modified drive circuit, the comparator 182*a* receives an electric signal voltage Va from control pressure sensor 80 and a divided voltage Vb higher than the signal voltage Va to produce a high level signal therefrom. Upon receiving the high level signal from comparator 182*a*, the power transistor 187 is turned on to energize the solenoid valve 70*b*. On the other hand, the comparator 181*a* receives the signal voltage Va and a divided voltage Vc lower than the signal voltage Va to produce a high level signal therefrom. Upon receiving the high level signal from comparator 181*a*, the power transistor 188 is turned on to energize the solenoid valve 70*a*.

Figure 16:
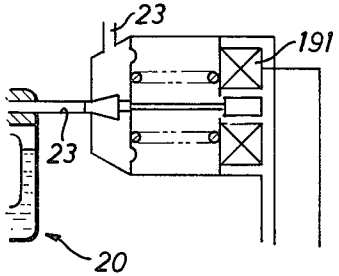
FIG. 16 illustrates a displacement detector assembled within the servo-motor in FIG. 2.

Furthermore, the vacuum sensor 50 may be replaced with a commercially available air flow meter to detect the flow quantity of sucked air. Thus, an electric signal indicative of the flow quantity of sucked air may be applied to the analog-to-digital conversion circuit 150 to obtain substantially the same effects as those of the above-described embodiment. In addition, the pressure control sensor 80 may be replaced with a displacement detector 191 such as a differential transformer, as shown in FIG. 16. The displacement detector 191 is housed within the housing 31 of servo motor 30 and operatively connected with the diaphragm member 35 to produce an electric signal indicative of an amount of displacements of the needle valve 32*c* which corresponds with changes of the pneumatic pressure in servo chamber 34.

Although the drive circuit 180 includes the comparators 181 and 182 in the above-described embodiment, the operational function of comparators may be programmed in computer 160, and also the secondary air passage 23 may be replaced with an appropriate air passage extending into primary air passage from the exterior through an air filter.

Having thus described the preferred embodiments of the invention it should be understood that numerous structural modifications and adaptations may be resorted to without departing from the spirit of the invention.

What is claimed is:

1. An electronic control system for a carburetor adapted to an internal combustion engine, said carburetor including an air induction passage with a venturi portion, a fuel passage supplying fuel from a float chamber into said venturi portion and an air passage permitting the flow of air into said fuel passage to be mixed with the fuel, said control system comprising:

a pneumatically operated servo-motor to be operated by pneumatic pressure applied thereto;

flow control means associated with said servo-motor for controlling the flow quantity of air through said air passage in accordance with changes of the pneumatic pressure applied to said servo-motor;

first means for producing a first electric binary signal indicative of rotational speed of said engine;

second means for producing a second electric binary signal indicative of intake manifold vacuum of said engine;

third means for detecting pneumatic pressure applied to said servo-motor to produce an electric signal indicative of the pneumatic pressure;

a digital computer for repetitively calculating a value indicative of optimum pneumatic pressure to be applied to said servo-motor in accordance with said first and second binary signals, said computer being programmed to calculate the optimum value from a function describing a desired relationship among optimum pneumatic pressure, rotational speed and intake manifold vacuum of said engine and to develop an electric binary signal from said optimum valve;

a digital-to-analog converter for converting said electric binary signal indicative of the calculated optimum value into an electric analog signal;

a drive circuit means for comparing a level of said electric signal from said third means with first and second levels derived from said electric analog signal to produce a first output signal therefrom when said first level is higher than the level of said electric signal from said third means and to produce a second output signal therefrom when said second level is lower than the level of said electric signal from said third means, said drive circuit means ceasing the output signals when the level of said electric signal from said third means is between said first and second levels; and first and second electrically operated valves to selectively apply engine intake manifold vacuum and atmospheric pressure respectively to said servo-motor when energized in response to one of said first and second output signals from said drive circuit.

2. An electronic control system for a carburetor as set forth in claim 1, wherein said second means further produces third and fourth electric binary signals respectively indicative of the atmospheric pressure and the temperature of sucked air, and said digital computer calculates said value indicative of optimum pneumatic pressure to be applied to said servo-motor in accordance with said first, second, third and fourth binary signals, said computer being programmed to calculate the optimum value from a function describing a desired relationship among optimum pneumatic pressure, rotational speed and intake manifold vacuum of said engine in consideration with the atmospheric pressure and the temperature of sucked air.

3. An electronic control system for a carburetor as set forth in claim 1, wherein said drive circuit means comprises;

a first comparator for comparing a voltage of said electric signal from said third means with a first divided voltage derived from said electric analog signal to produce a first output signal therefrom when said first divided voltage is higher than the voltage of said electric signal, and a second comparator for comparing the voltage of said electric signal from said third means with a second divided voltage derived from said electric analog signal to produce a second output signal therefrom when said second divided voltage is lower than the voltage of said electric signal, said first and second comparators ceasing said first and second output signals respectively when the voltage of said electric signal from said third means is between said first and second divided voltages.

4. An electronic control system for a carburetor as set forth in claim 1, wherein said third means electrically detects the operation of said servo-motor so as to produce an electric signal indicative of the pneumatic pressure applied to said servo-motor.

* * * * *